United States Patent [19]

Arnold et al.

[11] 4,279,229

[45] Jul. 21, 1981

[54] ELECTRONIC INJECTION-AMOUNT REGULATING APPARATUS IN AUTO-IGNITED INTERNAL COMBUSTION ENGINES

[75] Inventors: Herbert Arnold, Eberdingen; Gerd Gerhards, Hemmingen, both of Fed. Rep. of Germany

[73] Assignee: Robert Bosch GmbH, Stuttgart, Fed. Rep. of Germany

[21] Appl. No.: 928,215

[22] Filed: Jul. 26, 1978

[30] Foreign Application Priority Data

Aug. 6, 1977 [DE] Fed. Rep. of Germany ..... 2735596

[51] Int. Cl.[3] ..... F02D 1/04; F02D 1/06

[52] U.S. Cl. ..... 123/359; 123/353; 123/357

[58] Field of Search ..... 123/139 E, 32 AE, 353, 123/357, 359

[56] References Cited

U.S. PATENT DOCUMENTS

| | | | |
|---|---|---|---|
| 3,699,935 | 10/1972 | Adler | 123/139 E |
| 3,739,757 | 6/1973 | Ohtani | 123/139 E |
| 3,757,750 | 9/1973 | Ohtani | 123/139 E |
| 3,970,058 | 7/1976 | Tsumasaki | 123/139 E |
| 3,973,539 | 8/1976 | Jones | 123/139 E |
| 3,978,837 | 9/1976 | Lundberg | 123/139 E |
| 4,018,201 | 4/1977 | Williams | 123/139 E |
| 4,019,478 | 4/1977 | Hobo | 123/139 E |

*Primary Examiner*—Ronald B. Cox
*Attorney, Agent, or Firm*—Edwin E. Greigg

[57] ABSTRACT

An electronic injection-amount regulating apparatus in auto-ignited internal combustion engines in which the injection amount can be regulated by means of a regulator preferably having a PID characteristic and in which the injection amount is apportioned via a solenoid actuator and which includes a safety switching arrangement having an integral timing circuit resettable at each initiation of a control impulse for the solenoid actuator to prevent damage to the solenoid actuator in case of failure of the control signal, as well as a switching circuit for engine starting enhancement in a predetermined rpm range having as its most significant concept a series switching arrangement which includes a low-pass filter and a controllable threshold switch.

10 Claims, 1 Drawing Figure

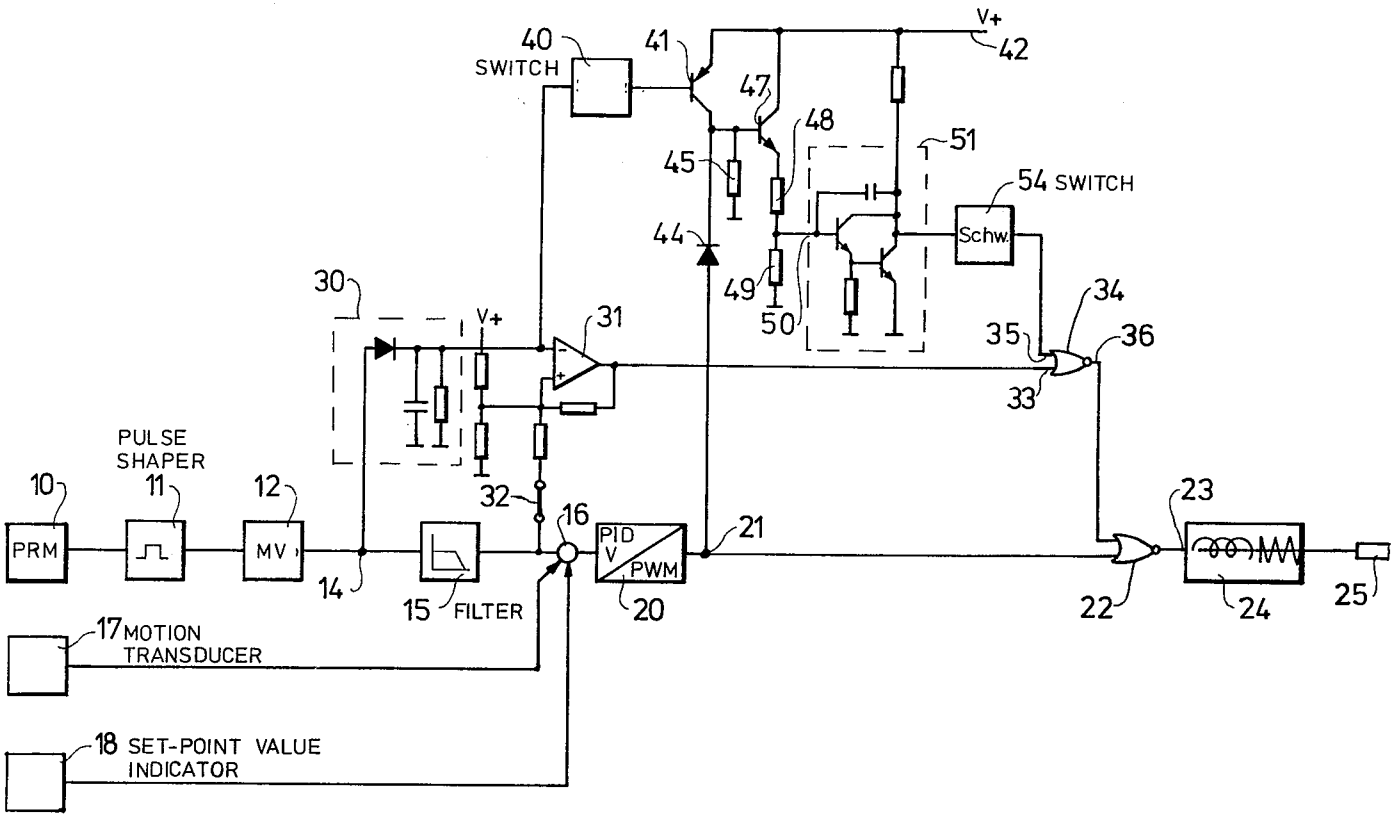
PRM
PULSE SHAPER
MV
FILTER
PID V PWM
SWITCH
Schw
SWITCH
MOTION TRANSDUCER
SET-POINT VALUE INDICATOR
V+
V+

ELECTRONIC INJECTION-AMOUNT REGULATING APPARATUS IN AUTO-IGNITED INTERNAL COMBUSTION ENGINES

BACKGROUND OF THE INVENTION

The invention is derived from an electronic injection-amount regulating apparatus of the type of the main claim. An injection-amount regulating apparatus is already known which has a solenoid actuator controlled via a PID regulator. The input signal of this PID regulator is derived from the set point value/actual value comparison of the speed, where, in addition, the setting of the solenoid actuator influences the regulatory circuit.

The disadvantage of the known injection-amount regulating apparatus is that there is no provision in case of failure of the control signal of the solenoid actuator and, further, that starting can be rough.

OBJECT AND SUMMARY OF THE INVENTION

The injection-amount regulating apparatus according to the invention has the advantage over the prior art in that a safety switching apparatus is associated with the solenoid actuator with which a continuous-wave-signal operation of the actuator can be prevented and with which, in case of failure, the solenoid actuator and thus the fuel supply can be turned off.

It is also an advantage of the switching apparatus of the invention for starting enhancement that the internal combustion engine is supplied with an increased amount of fuel in a certain rpm range after the onset of starting, which results in quieter running. This happens because the fuel in cold internal combustion engines condenses on the still-cold cylinder walls and thus has a limited propensity for ignition.

It has proved to be effective to employ parts of the switching apparatus for starting enhancement and for the safety switching apparatus as well, in order to keep the total cost low.

The invention will be better understood as well as further objects and advantages thereof become more apparent from the ensuing detailed description of a preferred embodiment taken in conjunction with the drawing.

BRIEF DESCRIPTION OF THE DRAWING

An exemplary embodiment of the invention is represented in the drawing and is further described below. Shown in the drawing is a schematic block diagram for the injection-amount regulating apparatus in accordance with the invention including the safety switching apparatus and the switching apparatus for starting enhancement.

DESCRIPTION OF THE PREFERRED EMBODIMENT

Referring now to the drawing, there is shown an rpm transmitter 10 whose output is connected with a pulse-shaping circuit 11. The output of pulseshaping circuit 11 is fed to the input of a monostable multivibrator 12. The unstable time of the monostable multivibrator 12 is selected such that at the rated speed, pulses are generated with a keying ratio of 1:1. The output of the monostable multivibrator 12 is connected to a junction 14, and then to a first low-pass filter 15.

The output of this low-pass filter 15 is connected to a summation point 16, to which signals are fed from a motion transducer 17 from which a setting of a solenoid actuator 24 is obtained. Signals from a set-point value indicator 18 are also fed to the summation point 16. A proportional-integral-derivative controller or PID regulator together with a voltage-to-keying-ratio converter, all included together in a regulator block 20, are also connected to the summation point 16. The output of the regulator block 20 is connected to a junction 21, and to the first input of a logic gate 22. The output of logic gate 22 is connected to the input 23 of a solenoid actuator 24 shown only schematically. The solenoid actuator 24 is coupled with a control rod 25 of an injection pump, not shown, and the control rod 25 is held in an outlet or stop position by the force of a spring when the solenoid is deenergized.

Between the low-pass filter 15 and the multivibrator 12, a second low-pass filter 30 is connected to the junction 14. The output of the filter 30 is connected to the negative input of a threshold switch 31. A switch 32 is connected between the output of the low-pass filter 15 and the positive input of the threshold switch 31 and by means of filters 15, 30, the threshold of the threshold switch 31 can be selected in accordance with the rpm. The output of the threshold switch 31 is connected with a first input 33 of a logic gate 34, which has a second input 35 as well as an output 36. The output 36 of gate 34 is connected with the second input of logic gate 22. The logic gate 34 operates as an OR gate and the logic gate 22 has the function of a NOR gate.

The connecting line between the low-pass filter 30 and the negative input of the threshold switch 31 is connected to a further threshold switch 40, whose output is coupled with the base of a transistor 41. This transistor 41 has its emitter connected with a positive voltage source 42 while its collector is connected via a diode 44 with the junction 21. The collector of transistor 41 is connected to ground through a resistor 45 and to the base of a subsequent transistor 47. The collector of the transistor 47 is connected to the positive line 42 and its emitter is connected to ground through a voltage divider made up of the resistors 48 and 49. The line which connects resistors 48 and 49 of the voltage divider is connected to an input 50 of a timing circuit 51, which includes a Miller integrator. The output of the timing circuit 51 is connected to a threshold switch 54, the output of which is coupled with the second input 35 of the OR logic gate 34.

The apparatus for the electronic regulation of injection amounts operates as follows:

The solenoid actuator 24 is fed with pulses having a predetermined keying ratio. These pulses create a current in the core of the solenoid, the response of which depends on the keying ratio. At the deviation of zero speed and of rated speed, the keying ratio is 1:1. Thus, the solenoid can be constructively set to values which do not include a continuous-wave-signal condition. For this reason, a safety switching circuit is needed to counteract the absence of pulse intervals.

During operation, the pulses of the rpm transmitter 10 are shaped in the pulse shaping circuit 11. The shaped pulses are fed to the monostable multivibrator 12 which generates pulses with a ratio of 1:1 at rated speed. The output signal of the lowpass filter 15 which follows the monostable multivibrator 12 has a level at low rpm which corresponds to the supply voltage. At the rated speed, this level is reduced by half and is further reduced as the rated speed increases. The output signals of the low-pass filter 15, the motion transducer 17 (which effects the setting of the solenoid actuator 24) and the set-point value indicator 18 are combined with each other at the summation point 16 and the combined signal is fed to the regulator block 20 provided with the PID regulator and the voltage-to-keying ratio converter. When the rpm are zero, the output signal of the regulator block 20 has a zero voltage value, so that at the output of the NOR logic gate 22, a positive signal is produced if there is a zero signal at the second input thereof. The positive signal at the output of the NOR logic gate 22 exerts an attraction on the core of the solenoid actuator 24 and thus produces a displacement of the regulating rod 25 in the fullload direction. With an increase in rpm, a pulseshaping signal results at the output of the regulator block 20 with an increasing keying ratio. As a result, the signal at the input 23 of the solenoid amount actuator 24 is increasingly limited and thus the regulating rod 25 is drawn back from its full-load position.

To this mode of operation, the function of the switching apparatus for starting enhancement and the function of the safety switching apparatus can be added.

At zero rpm, that is, when the internal combustion engine is at rest, the output signal of the low-pass filter 30 is zero. The output signal of the threshold switch 31 is the same as the supply voltage V+. Thus, the output signal of the OR logic gate 34 is at high potential and the output signal of the NOR logic gate 22 is at zero. The regulator rod 25 is then at a zero setting. The integrationtime constant of the low-pass filter 30 is designed in such a way that after a few revolutions, the condenser voltage has risen to the threshold voltage of the threshold switch 31, whereby the output signal of the threshold switch 31 falls to zero. As a result, the input of the solenoid actuator 24 is at operational voltage potential as long as the output signal of the regulator block 20 is also still at zero. This starting enhancement continues until the regulatory range of the PID regulator in the regulator block 20 is reached and the regulator block 20 takes over the control of the solenoid actuator 24. When the switch 32 is closed, the threshold of the threshold switch 31 may be determined by the rpm, so that the starting enhancement is only begun above, for example, 200 rpm.

The safety switching apparatus serves to prevent continuous-wave-signal operation of the solenoid actuator 24. For this reason, in the switching arrangement shown, an input signal is required at the input 35 of the OR logic gate 34 whenever the potential at the NOR logic gate 22 at the output of the regulator block 20 has a prolonged low value. At zero rpm the signal at the output of the lowpass filter 30 has an amplitude which does not yet allow the threshold switch 40, at the input of the safety switching apparatus, to respond and turn on the transistor 41. Thus a high voltage drop occurs via the resistor 45, and the transistor 47 switches on keeping the input 50 of the timing circuit 51 at high potential. The output signal of the timing member 51 is therefore low; the threshold switch 54 does not respond. Thus, there is no voltage at the input 35 of the OR logic gate 34. After a few revolutions of the cam of the internal combustion engine, the potential at the output of the low-pass filter 30 has risen above the threshold of the threshold switch 40; the threshold switch 40 switches its output to high potential turning on transistors 41 and 47. In this way, the input potential of the timing circuit 51 is reduced and the charging process of the condenser contained in the timing circuit can begin. After the threshold value of the threshold switch 54 is reached, the threshold switch 54 switches over and eventually turns off the voltage at the input 23 of the solenoid actuator 24. The unstable time of the Miller integrator contained in the timing circuit 51 is set at such a large value, approximately 20 to 30 seconds, such that under normal operating conditions, the switchover threshold of the subsequent threshold switch 54 is not reached.

If the regulator block 20 produces positive output pulses, then the transistor 47 turns on so that the input potential of the timing circuit 51 is raised. As a result of this, the output voltage collapses and a positive signal occurs at the input 23 of the solenoid actuator 24 during the subsequent pulse interval of the output signal of the regulator block 20.

The switching apparatus shown for enhancement during starting indicates clearly, with the switch 32, the possibilities for variation of the type of starting enhancement. Thus when switch 32 is opened, the threshold of the threshold switch 31 is constant. When the switch 32 is closed, the threshold is dependent on the rpm. Another possibility is dependence on the temperature as well as on the time.

The setting of the control rod 25 is controlled by means of the motion transducer 17, which leads to an increase in the precision of setting.

By means of the present apparatus for electronic injection-amount regulation it is possible to monitor the control of the solenoid actuator 24 in an optimal way, independently of any possible rpm regulation accomplished by mechanical means. Further, the switching apparatus for starting enhancement accomplishes a trouble-free start and thus great convenience of operation.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An apparatus for the electronic regulation of injection amounts in internal combustion engines with autoignition comprising means regulating the injection amount of fuel with a pulsed control signal from a regulator having a PID characteristic and where said means producing said control signal indicative of the injection amount is apportioned via a solenoid actuator responsive to a safety switching means, said safety switching means being responsive to the absence of pulse intervals in the control signal for deenergizing the solenoid actuator, a logic gate connected in series with the input of the solenoid actuation and including means for feeding the output signals from the regulator as well as the output signal from said safety switching means to said logic gate.

2. An apparatus according to claim 1, wherein said safety switching means includes a timing circuit having a resettable integrator.

3. An apparatus according to claim 1 wherein said logic gate is a NOR gate.

4. An apparatus according to claim 1 including starting enhancement switching means for producing a high value for the injection amount at low rpm and having a timing circuit including a low-pass filter for providing an input signal for both the starting enhancement switching means and the safety switching means.

5. An apparatus according to claim 4, wherein said starting enhancement switching means is arranged to be regulated in accordance with the rpm and time.

6. An apparatus according to claim 4, characterized in that the termination of the starting enhancement by said starting enhancement switching means is dependent on the temperature.

7. An apparatus according to claim 4 wherein said starting enhancement switching means is arranged for starting enhancement up to the time that the rpm of the internal combustion engine have reached the operational range of the regulator.

8. An apparatus according to claim 4 including a logic gate and means for feeding the output signals of said safety switching means and said starting enhancement switching means to said logic gate.

9. An apparatus according to claim 8 including an rpm transmitter for producing an output signal, a timing circuit with an output having a constant pulse duration, means for feeding said rpm transmitter output signal to said timing circuit, a pair of low-pass filters having different time constants, means for coupling said timing circuit output to said low-pass filters, one of said low-pass filters being coupled in series to the regulator and the other of said low-pass filters being arranged to deliver an input signal both to said starting enhancement means provided with a threshold switch and to said safety switching means having a timing circuit.

10. An apparatus according to claim 2, including a coupling circuit having at least one transistor for connecting said timing circuit having said resettable integrator to the output of the regulator.

* * * * *